US006832443B1

(12) United States Patent
Piel et al.

(10) Patent No.: US 6,832,443 B1
(45) Date of Patent: Dec. 21, 2004

(54) CUTTING CHAIN

(75) Inventors: Martin Roy Piel, Perry, OK (US); John H. Walgren, Lake Havasu City, AZ (US)

(73) Assignee: The Charles Machine Works, Inc., Perry, OK (US)

( * ) Notice: Subject to any disclaimer, the term of this patent is extended or adjusted under 35 U.S.C. 154(b) by 37 days.

(21) Appl. No.: 10/081,420

(22) Filed: Feb. 22, 2002

Related U.S. Application Data

(60) Provisional application No. 60/270,920, filed on Feb. 23, 2001.

(51) Int. Cl.[7] ..... E02F 3/14; E02F 3/08

(52) U.S. Cl. ..... 37/352; 37/465

(58) Field of Search ..... 37/347, 352, 353, 37/357, 359, 360, 450, 452, 455, 465, 454, 456; 299/84.1, 34.01, 34.04, 82.1, 83.1, 91, 100, 82–84; 83/830, 831, 833, 834

(56) References Cited

U.S. PATENT DOCUMENTS

| | | | | | |
|---|---|---|---|---|---|
| 2,575,980 | A | | 11/1951 | Simmons | 262/33 |
| 2,675,219 | A | | 4/1954 | Proctor | 262/33 |
| 2,736,352 | A | * | 2/1956 | Wright | 83/831 |
| 3,484,844 | A | | 12/1969 | Petersen | 37/142 |
| 3,498,677 | A | | 3/1970 | Morrow | 299/86 |
| 3,614,164 | A | | 10/1971 | Davis | 299/83 |
| 3,913,979 | A | | 10/1975 | Strauss et al. | 299/84 |
| 4,043,135 | A | | 8/1977 | Hoes et al. | 61/72.5 |
| 4,775,189 | A | | 10/1988 | Den Besten | 299/82 |
| 4,813,323 | A | * | 3/1989 | Harfst | 83/830 |
| 4,924,609 | A | | 5/1990 | Martin | 37/191 |
| 5,248,188 | A | | 9/1993 | Walgren | 299/83 |
| 5,788,422 | A | | 8/1998 | Gardner et al. | 405/267 |
| 5,813,151 | A | | 9/1998 | Stephens et al. | 37/352 |
| 6,014,826 | A | | 1/2000 | Walgren et al. | 37/456 |
| 6,141,892 | A | | 11/2000 | Moore et al. | 37/352 |
| 6,154,987 | A | | 12/2000 | Rumer et al. | 37/352 |
| 6,286,905 | B1 | | 9/2001 | Kimura et al. | 299/39.3 |

* cited by examiner

*Primary Examiner*—Robert E Pezzuto
(74) *Attorney, Agent, or Firm*—McKinney & Stringer, P.C.

(57) ABSTRACT

The invention is directed to an endless cutting chain for an underground trenching assembly that has a plurality of cutter links with a strap link joining adjacent cutter links. Each cutter link has a pair of side plates and a support member bridging the side plates. The support member has an arcuate support surface for attachment of at least one cutting member. The support member and the cutting members are adapted so as to permit substantially unrestricted selection of lateral positions of the cutting members on the arcuate support surface of the support member. Additionally, some cutter links on the cutting chain have an arcuate drag plate attached to the support member of the cutter link. The drag plate in combination with the arcuate support surface produces a cleaner round bottom trench 11. Additionally, the drag plate provides wear protection to the chain rivet heads.

44 Claims, 8 Drawing Sheets

CUTTING CHAIN

CROSS REFERENCE TO RELATED APPLICATION

This application claims the benefit of U.S. Provisional Application No. 60/270,920 filed Feb. 23, 2001, the contents of which are incorporated fully herein by reference.

FIELD OF THE INVENTION

This invention relates generally to the field of underground trenching and more particularly but not by way of limitation to endless cutting chains used in cutting and removing subterranean matter in forming a trench.

BACKGROUND OF THE INVENTION

Underground trenching apparatus for excavating trenches are well known in the art. Trenches are excavated to lay pipe, utility and cable lines, curb preparation and other like purposes. The conventional underground trenching machines usually includes a frame, a chain, a plurality of cutting teeth and a power transmission. The frame has ground-engaging wheels and the boom is attached to and extends outwardly from the frame. The chain extends around the periphery of the boom in much the same manner as a chain that extends around the bar of a chain saw.

The plurality of cutting teeth are mounted on the chain and the transmission is mounted on the frame. The transmission is used for driving the chain around the boom such that the chain can dig a trench in the ground. Typically, the boom is movable between a raised position in which the cutting teeth do not contact the ground and a lowered position in which the cutting teeth engage the ground. In the lowered position, as the cutting teeth engage and loosen the soil, the teeth and chain drag the loosened ground material to the surface where a conveying auger moves the ground materials to the side of the trench.

Another such prior art trenching apparatus includes a cutting chain with a plurality of cutting links, with each cutting link having a planar flat surfaced plate to mount the cutting teeth. This type of a cutting chain will cause a flat bottom trench to be excavated. It is desirable to provide an improved cutting chain of the type described in the present invention that provides for excavation of a round bottom trench.

Additionally, because of the planar, flat surface of the mounting plates of each cutting link, the loose dirt, spoils or broken materials are not effectively conveyed out of the trench by the cutting chain. Therefore, it is desirable to provide an improved cutting chain of the type described in the present invention that provides a cost effective and time efficient mechanism to more effectively drag the dirt, spoils, broken materials, etc. to the surface thereby producing a much cleaner trench and improving the trenching performance of the cutting chain.

Also, it is well known in the prior art to employ one or two cutting teeth for each cutting link of the cutting chain. The cutting teeth may be arranged longitudinally on a support surface of some sort of each cutting link. The cutting teeth are then secured to the support surface generally by fasteners or other retaining means. However, the fasteners are often loosened during operation of the cutting chain thereby necessitating repeated tightening of the fasteners.

Additionally, in other prior art trenching apparatuses, the cutting teeth are detachably secured in sockets by using retainers. The retainers are inserted in the socket wall and compressed between the cutting tooth and the socket wall. However, this securing mechanism substantially restricts the number of cutting teeth that may be secured on the support surface of each cutting link due to the mass of the socket and access to the retainers. Also, the selection of lateral positions available to the cutting tooth for attachment on the support surface are limited.

Thus there exists a need in the industry to provide an improved cutting chain of the type described in the present invention that provides for more flexibility for mounting cutters on a support surface of a cutting link. These and other further advantages of the present invention will become apparent to those skilled in the art from the following detailed description and drawings.

SUMMARY OF THE INVENTION

The present invention is directed to a cutting chain comprising a plurality of cutter links with a strap link joining adjacent cutter links forming an endless chain. At least one cutter link of the cutting chain comprises a pair of side plates, a support member, at least one cutting member, and a drag plate. The support member bridges the side plates and has an arcuate support surface. At least one cutting member is attached onto the arcuate support surface of the support member. Additionally, the drag plate is attached to the support member.

In another aspect, the present invention is directed to a cutter link for a cutting chain. The cutter link comprises a pair of side plates, a support member; at least one cutting member, and a drag plate. The support member is arcuately shaped and bridges the side plates. At least one cutting member is attached onto the support member. Additionally, the drag plate is attached to the support member.

In still another aspect, the present invention is directed to a cutting chain comprising a plurality of cutter links forming an endless chain. At least one cutter link of the endless cutting chain comprises a support member, wherein the support member has a pair of side sections, a bridge section, and a plurality of cutting members. The pair of side sections is spaced apart and planar. The bridge section is interposed between the side sections and has an arcuate support surface formed in a medial portion thereof. The plurality of cutting members is supported by the arcuate support surface.

The invention is further directed to a cutter link for a cutting chain comprising a support member and a plurality of cutting members. The support member has an arcuate support surface. The plurality of cutting members is disposed in laterally offset relationship at substantially the same longitudinal position on the arcuate support surface. Additionally, the support member and the cutting members are adapted to permit substantially unrestricted selection of the lateral position of each cutting member on the arcuate support surface of the support member.

In yet another aspect, the present invention is directed to a cutting chain comprising a plurality of cutter links with a strap link joining adjacent cutter links to form an endless chain. At least one cutter link of the endless cutting chain comprises a pair of side plates, a support member, and a drag plate. The support member bridges the side plates and has an arcuate support surface. Additionally, the support member is characterized by an unobstructed arcuate interior passage that extends substantially parallel to the direction of travel of the cutting chain. The drag plate is attached to the support member.

In still another aspect, the present invention is directed to a cutting chain comprising a plurality of cutter links. A strap link joins adjacent cutter links using a pair of fastening members to form an endless chain. At least one cutter link of the endless chain comprises a pair of side plates, a support member, and a drag plate. The support member bridges the side plates. Further, the drag plate comprises an upper arcuate portion and a pair of side portions. The upper arcuate portion is attached to the support member. The pair of side portions extend downward from the upper arcuate portion. Additionally, each side portion is attached to and extends outwardly from a corresponding side plate such that each side portion forms a shield for the corresponding fastening number.

BRIEF DESCRIPTION OF THE DRAWINGS

FIG. 16 is a side view of the trenching assembly illustrating the cutting chain of FIG. 1 in the trenching position.

DETAILED DESCRIPTION OF THE PREFERRED EMBODIMENTS

Figure 1:
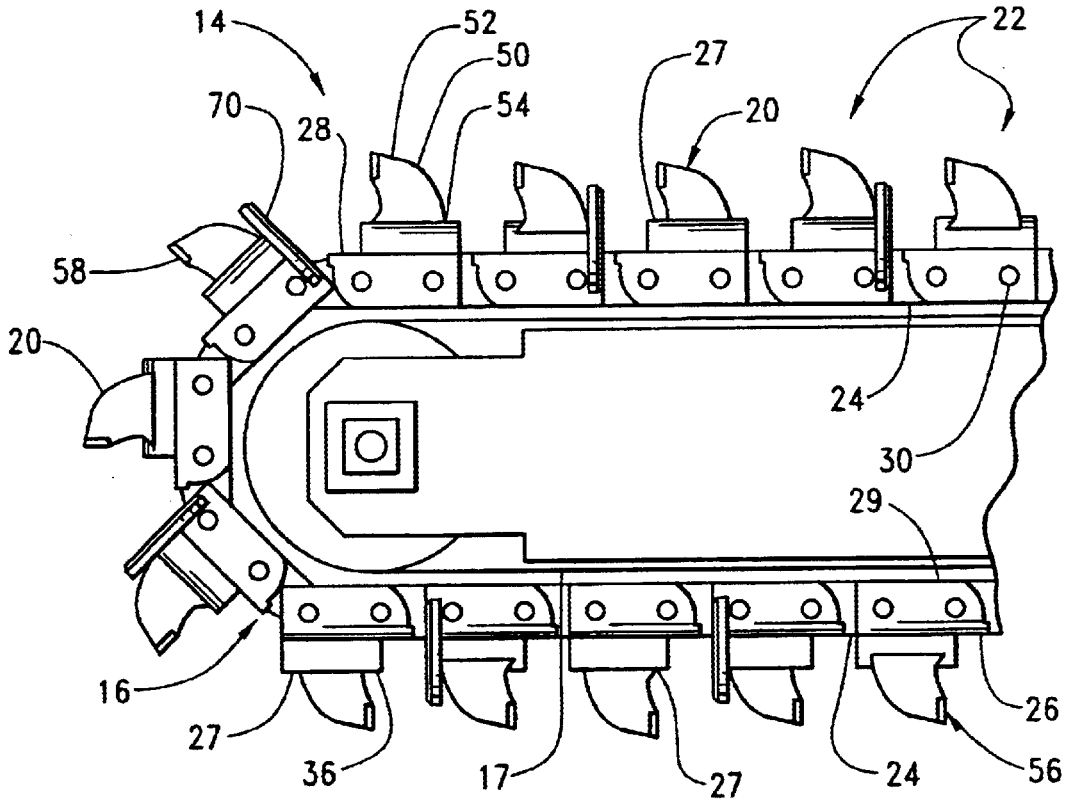
FIG. 1 is a side elevational view of a portion of the cutter bar assembly of an underground trenching apparatus, illustrating an endless cutting chain constructed in accordance with the present invention trained around the cutter bar of the cutter bar assembly.
Figure 2:
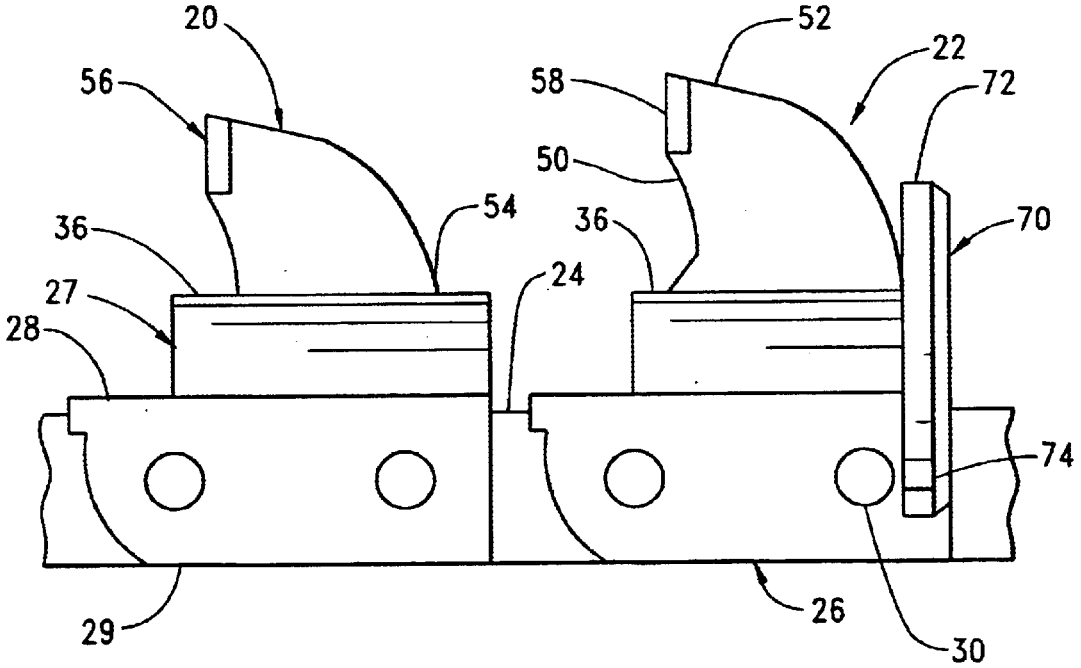
FIG. 2 is an enlarged view of a portion of the cutting chain assembly of FIG. 1 illustrating two consecutive cutting links in the cutting chain.
Figure 3:
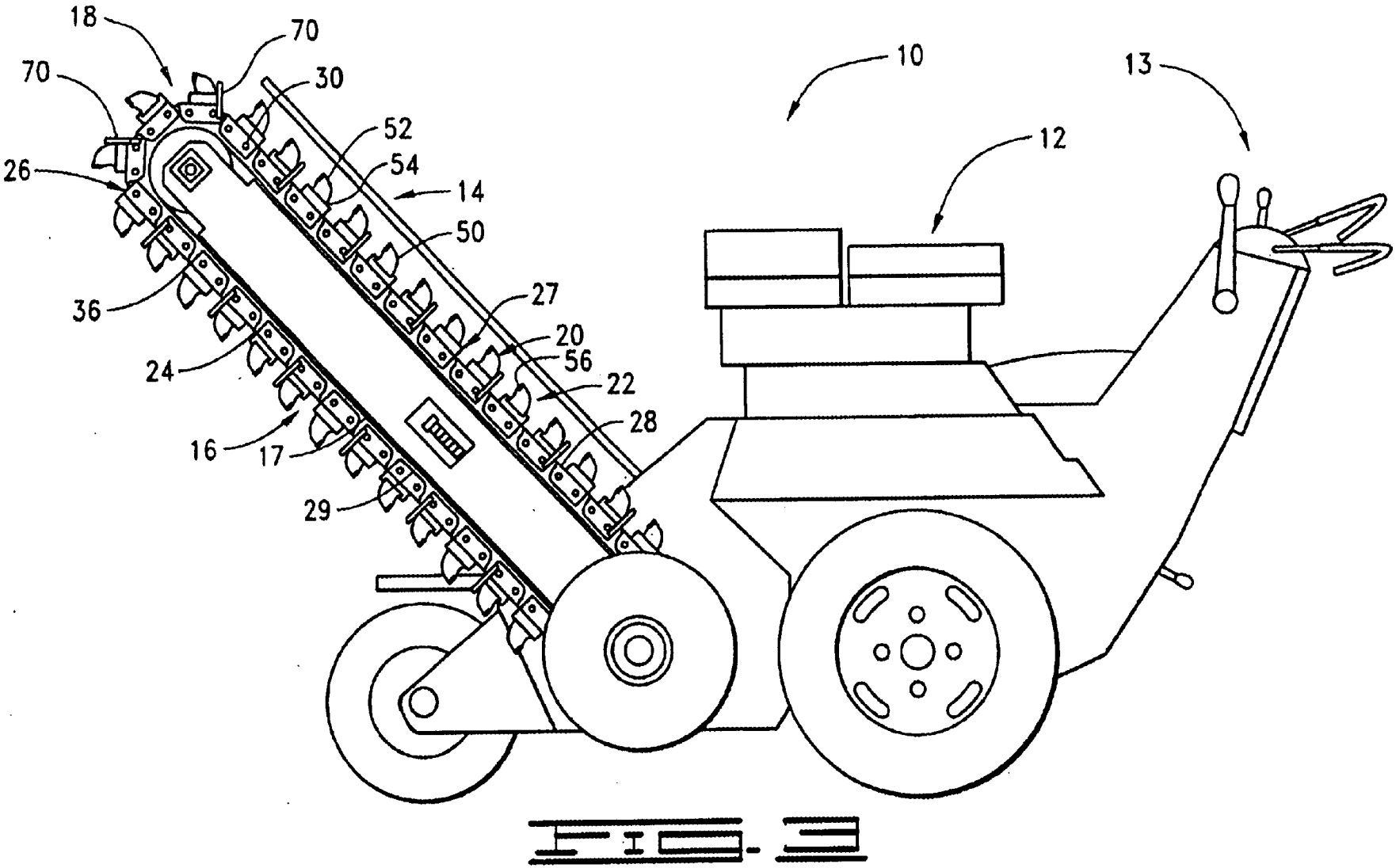
FIG. 3 is a side view of the trenching assembly illustrating the cutting chain of FIG. 1 in the transport position.

Turning now to the drawings in general, and to FIGS. 1–5 and FIG. 16 in particular, shown therein is a view of an underground trenching assembly 10 to excavate a trench 11 (FIG. 16), that is constructed in accordance with the present invention. While the invention is described in connection with an underground trenching assembly 10 as illustrated in FIG. 3, it is to be understood that the present invention can be readily adapted for use with other assemblies such as coal cutting machines, mining machines, and other ground penetrating assemblies.

As shown in FIG. 3 and FIG. 16, the underground trenching assembly 10, comprises a main frame 12 which supports a power plant 13 and a cutting bar assembly 14. The cutting bar assembly 14 comprises an endless cutting chain 16 and an elongate cutter bar 17. The elongate cutter bar 17 is pivotally supported at its lower end by the main frame 12. The endless cutting chain 16 is supported by and extends around the periphery of the cutter bar 17. The endless cutting chain 16 may be caused to travel around the cutter bar 17 by a chain drive mechanism powered by the power plant 13. Power plants 13 are well known in the trenching apparatus art, and therefore, will not be discussed here.

By pivotal movement of the cutter bar 17, the cutting bar assembly 14 may be moved between a transport position 18, shown in FIG. 3, and a trenching position 19, shown in FIG. 16. In the transport position 18, the cutter bar 17 and cutting chain 16 do not contact the ground, thus facilitating transport of the underground trenching assembly 10 from place to place. In the trenching position 19, on the other hand, the cutter bar 17 is pivotally lowered until cutting members 20 on the cutting chain 16, contact and excavate the trench 11 in the ground as will be discussed later.

As shown in FIGS. 1–4, the endless cutting chain 16 is preferably formed from a strong and durable material such as steel. Comprising the endless cutting chain 16 are a plurality of cutter links 22 disposed in end-to-end engagement. Each adjacent pair of cutter links 22 are interconnected by a pair of strap links 24 so as to form the endless cutting chain 16.

Figure 5:
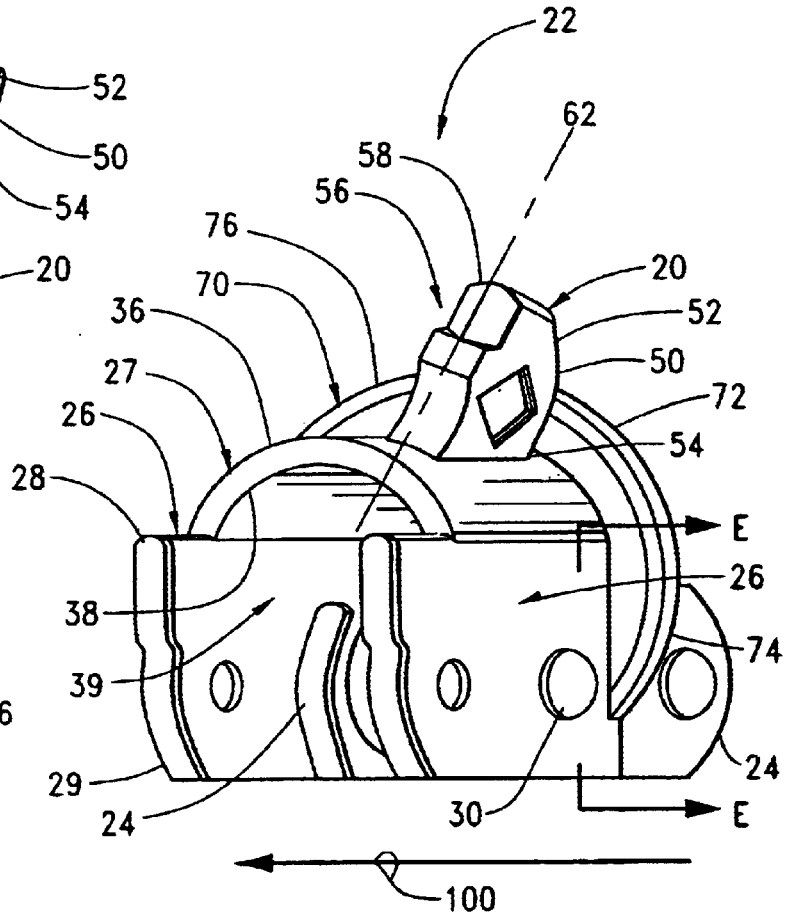
FIG. 5 is an isometric illustration of a cutting link suitable for use in a cutting chain constructed in accordance with the present invention.

With reference to FIG. 5, each cutter link 22 preferably comprises a pair of planar side plates 26 and a support member 27. The side plates 26 preferably are of equal size and dimension and are disposed in spaced and parallel relationship on opposite sides of the longitudinal centerline of the endless cutting chain 16. Each side plate 26 is characterized by an upper end 28 and a lower end 29. The lower end 29 of the side plate 26 is connected to the strap link 24 by a rivet 30. However, any other type of fastening mechanism such as hinge pins may be used without departing from the scope of the invention. The upper ends 28 of the side plates 26 are attached to the support member 27 as follows.

The support member 27 may be made of a hard alloy such as steel or any other durable metal capable of withstanding the varied ground materials and harsh weather conditions. The support member 27 interconnects or bridges each opposing pair of side plates 26 adjacent their upper ends 28. The support member 27 and the side plates 26 may be formed integrally, as by welding or casting, or may be removably connected, by use of any other type of fasteners.

The support member 27 is preferably characterized by an arcuate support surface 36 formed in a medial portion thereof, as best shown in FIG. 5. The arcuate support surface 36 has a convex outer surface. At least one cutting member 20 may be attached to the arcuate support surface 36. The manner in which the cutting members 20 are attached to the arcuate support surface 36 will be discussed in greater detail later. Preferably, an underside 38 of the support member 27 together with the inner surfaces of the side plates 26 of each cutter link 22 of the cutting chain 16 defines an interior passage 39 that extends substantially unobstructed there through in a direction substantially parallel to the longitudinal centerline of the endless cutting chain 16, and thus its direction of travel.

With reference to FIG. 5, there is shown therein a preferred embodiment of a cutting member 20. Preferably, the cutting member 20, comprises a body 50 having a top end 52 and a bottom end 54. The top end 52 of the body 50 of the cutting member 20 has a cutting bit 56 mounted in it that defines a cutting edge 58. Preferably, the body 50 is made of a hard alloy such as steel whereas the cutting bit 56 is made from carbide.

However, the cutting bit 56 may be made from any other hard cutting material capable of fracturing the varied variety of trenching materials. Similarly, the body 50 may be made of any other solid material capable of withstanding trenching through varied soil materials and harsh weather conditions. The body 50 and the cutting edge 58 define a plane 62 that may be canted or uncanted relative to a direction of travel of the cutting chain 16 as will be discussed in detail later.

With continued reference to FIG. 5, preferably the cutting member 20 is fixedly attached to the arcuate support surface 36 of the cutter link 22, such as by welding or a fastening member. However, any other mode of attachment that will fixedly attach the cutting member 20 to the arcuate support surface 36, such as bolting, may be used. Alternatively, the cutting member 20 may be removably attached to the arcuate support surface 36.

Figure 4:
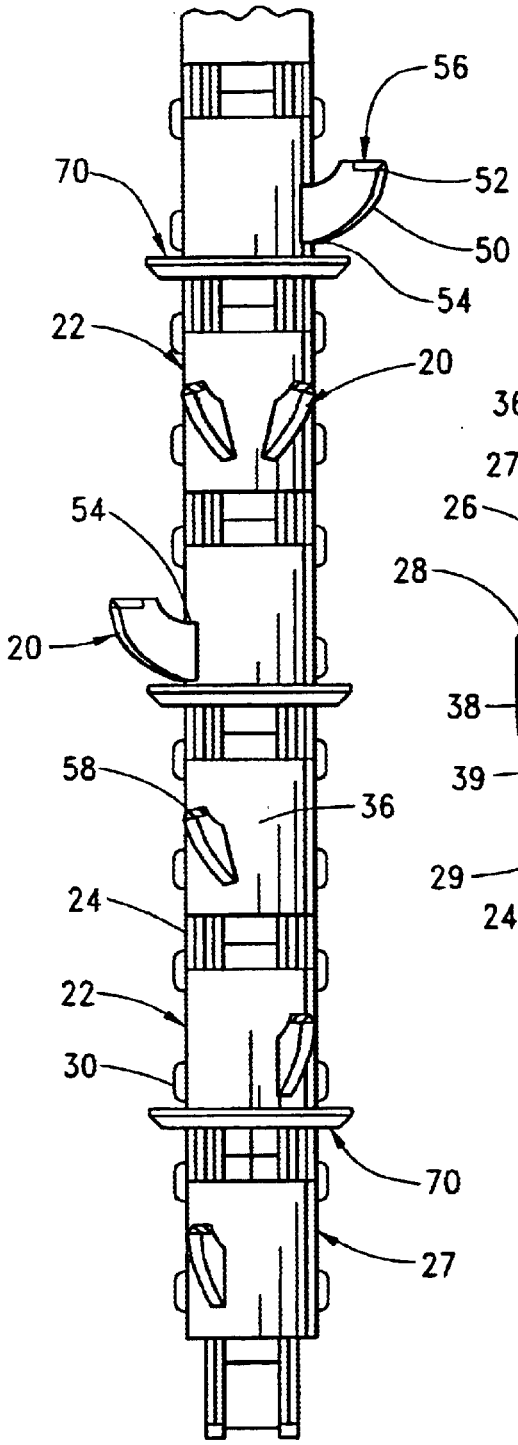
FIG. 4 is a top view of a portion of the cutting chain of FIG. 3.

In the embodiments illustrated in FIGS. 1, 3, 4 and 16, there is shown therein the preferred manner in which adjacent cutting members 20 of the type illustrated in FIG. 5 are arranged on the support member 27 of adjacent cutter links 22. Adjacent cutting members 20 are disposed in a staggered pattern on adjacent support members 27. That is, in a front view of the cutting chain 16, preferably, the cutting members 20 on adjacent support members 27 will not be aligned directly behind each other in a line parallel to the direction of travel of the cutting chain 16. Instead, the cutting members 20 are arranged such that the cutting members on adjacent cutter links 22 occupy varied lateral positions along the arcuate support surface 36 of the support member 27 as shown in FIG. 4. This arrangement of cutting members 20 is sometimes referred to as the lacing pattern.

In addition to the arcuate support surface 36 of the support member 27 of each cutter link 22 for supporting the cutting members 20, some cutting links further comprise an additional attachment such as a drag plate 70 in a manner and for a purpose yet to be described. In the preferred embodiments illustrated in FIGS. 1–5 and FIG. 16, the cutting chain 16 of the present invention preferably comprises at least one drag plate 70, and alternatively may comprise a plurality of drag plates 70. For example, every other cutter link 22 in the cutting chain 16 may support a drag plate 70 as illustrated in FIGS. 1–4 and FIG. 16, or the drag plate may be attached to the outer surface of the support member 27 of each cutter link 22.

With continued reference to FIG. 5, the drag plate 70 preferably, is made from a hard alloy such as steel. However, any other metal capable of withstanding the harsh weather conditions and trenching through varied soil materials may be used without departing from the scope of the invention. The drag plate 70 comprises an upper portion 72 and a pair of side portions 74 extending downwardly from the upper portion. The upper portion 72 has an arcuate upper edge 76 fixedly attached to the convex outer surface of the support member 27. The side portions 74 (only one shown in FIG. 5) of the drag plate 70 extend downwardly and outwardly and can be supported by the side plates 26, such as by a welded attachment thereto, for a purpose yet to be discussed.

With reference to FIGS. 12–15, there are shown therein different views of a preferred embodiment of the drag plate 70 of FIGS. 1–5 and FIG. 16 constructed in accordance with the present invention. The drag plate 70 comprises a central opening 80 that receivingly engages the cutter link 22 (see FIG. 5), to permit attachment thereto. The drag plate 70 is attached to the support member 27 such as by welding along a surface 82 that provides a substantially closely fitting relationship with the side plates 26 and the convex outer surface of the arcuate support surface 36. However, any other mode of attachment that permits the drag plate 70 to be closely attached to the support member 27 may be used. Alternatively, the drag plate 70 may be removably attached to the support member 27 without departing from the scope of the invention.

The drag plate 70 can be attached substantially orthogonally relative to the longitudinal axis of the support member 27. Alternatively, the drag plate can be attached non-orthogonally relative to the longitudinal axis of the support member 27. That is, the drag plate 70 can be selectively tilted to direct the loose cutting material out of the trench 11. Additionally, in the preferred embodiment, the drag plate 70 is characterized by a concave excavating surface in order to facilitate the dragging action.

Figure 6:
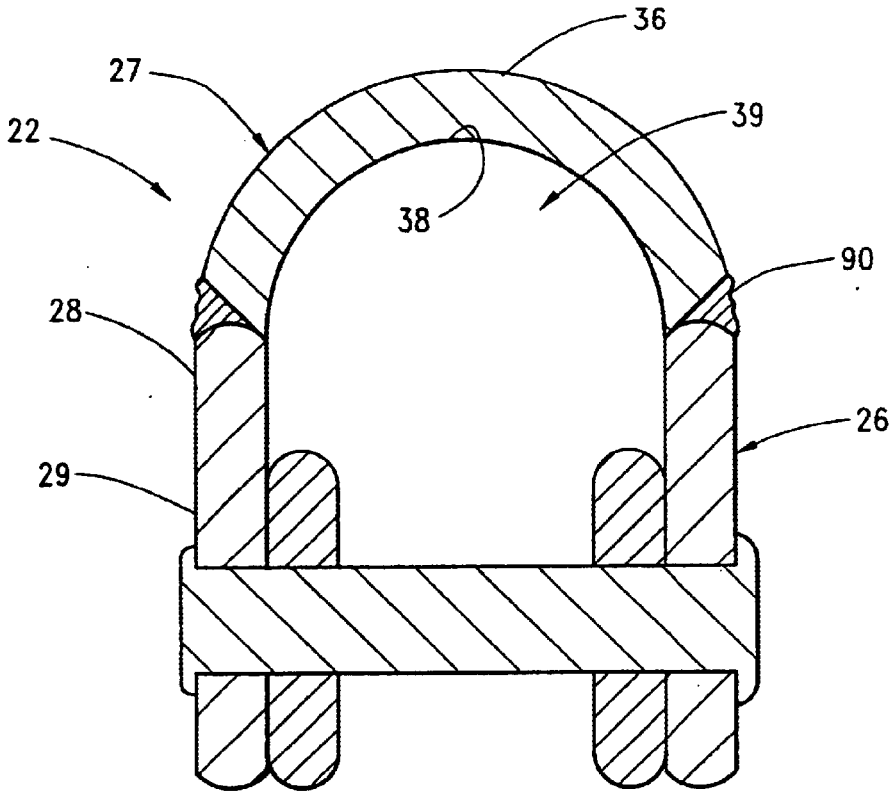
FIG. 6 is a cross sectional view of the cutting link of FIG. 5 taken along line E—E in FIG. 5, illustrating an embodiment of the present invention wherein the support member comprises an arcuate support surface bridging the side plates.
Figure 7:
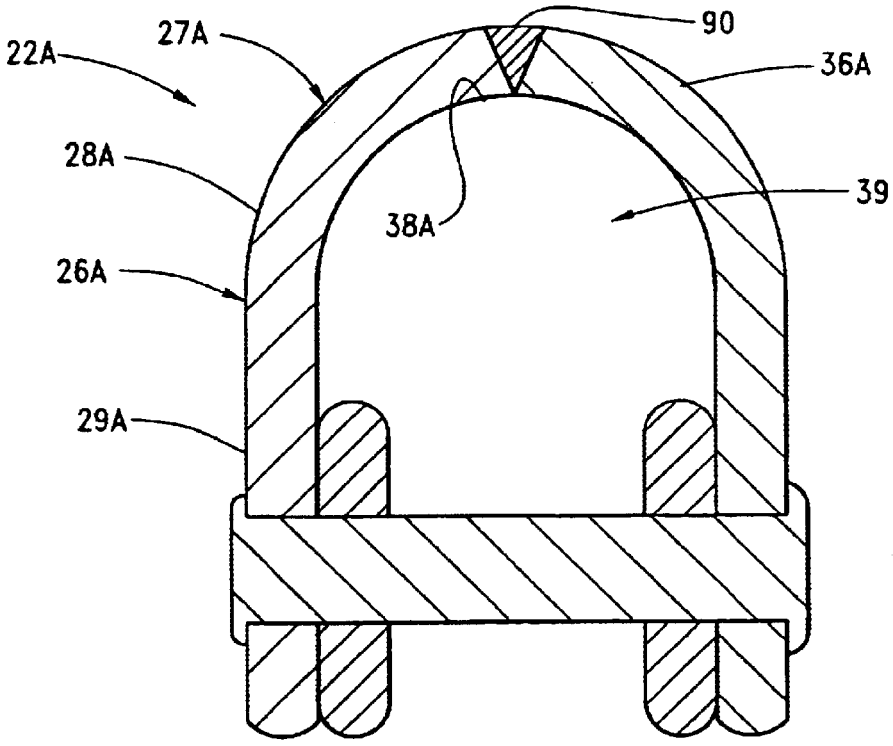
FIG. 7 is a cross sectional view similar to FIG. 6 illustrating another embodiment of the present invention wherein the support member is formed from arcuate extended portions of the side plates.
Figure 8:
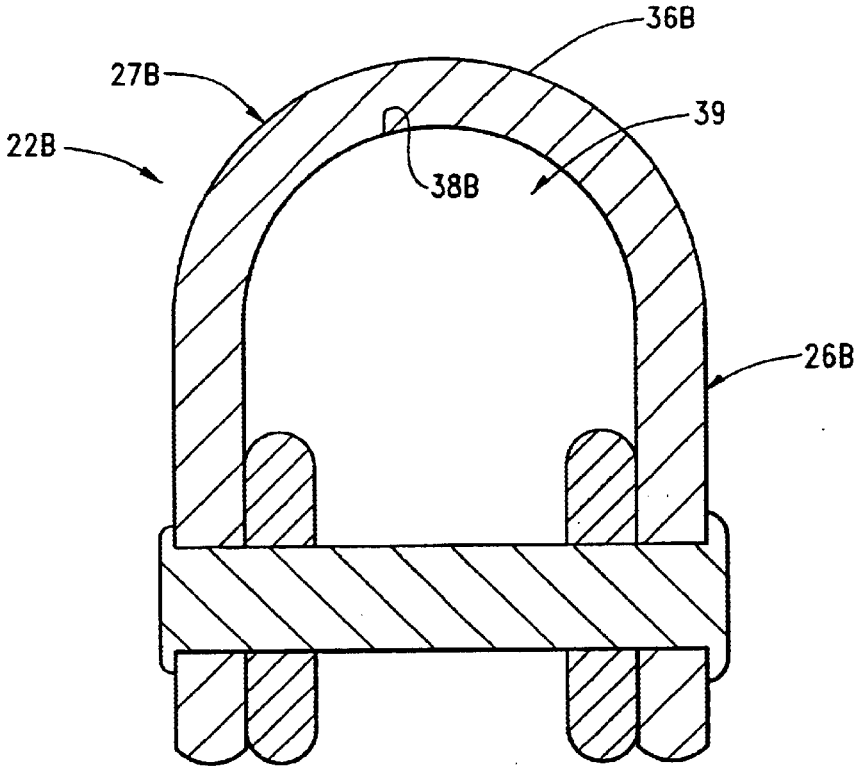
FIG. 8 is a cross sectional view similar to FIG. 6 illustrating another embodiment of the present invention wherein the support member and side plates are unitarily formed.

FIGS. 6–8 illustrate preferred embodiments of the support member 27 of the cutter link 22 illustrated in FIGS. 1–4 and 16. The support member 27 may be separate from and attached to the side plates 26, or may be part of the side plates. Alternatively, the support member 27 may be a single unitary structure as will be discussed below. In the preferred embodiment illustrated in FIG. 6, the support member 27 of the cutter link 22 is separate from and bridges the side plates 26. In this embodiment, the support member 27 defines the arcuate support surface 36 that forms the bridge between the side plates 26.

The arcuate support surface 36 is fixedly attached to the upper end 28 of the side plates 26 of the cutter link 22, such as by weldments 90. However, any other mode of attachment that will fixedly attach the support member 27 to the pair of side plates 26 may be used. Alternatively, the support member 27 may be removably attached to the side plates 26.

With reference to FIG. 7, there is shown therein, another preferred embodiment of the support member 27A of the cutter link 22A. Each upper end 28A of the pair of side plates 26A has an arcuate portion that opposingly mate and join together with the corresponding opposite arcuate portion, such as by the weldment 90. However, any other mode of attachment that will fixedly attach the upper arcuate portions may be used. Alternatively, the arcuate upper portions 28A may be removably attached to each other. The joined upper arcuate portions 28A provide an arcuate support surface 36A for attachment of at least one cutting member 20 to support member 27A.

In another preferred embodiment of the support member 27B illustrated in FIG. 8, the support member 27B has a pair of spaced apart, parallel, opposed, planar side plates 26B that are provided as portion of a unitary construction comprising a u-shaped arcuate support surface 36B. That is, the side plates 26B have a bridge section interposed between the side sections that comprises an arcuate support surface 36B formed in a medial portion of the support member 27. Similarly, the arcuate support surface 36B provides a supporting surface for attachment of a plurality of cutting members 20. Thus, as discussed above, the support members 27, 27A and 27B illustrated in FIGS. 6–8 respectively, illustrate preferred embodiments of an arcuate support surface 36, 36A and 36B respectively, for the attachment of at least one cutting member 20.

Figure 9:
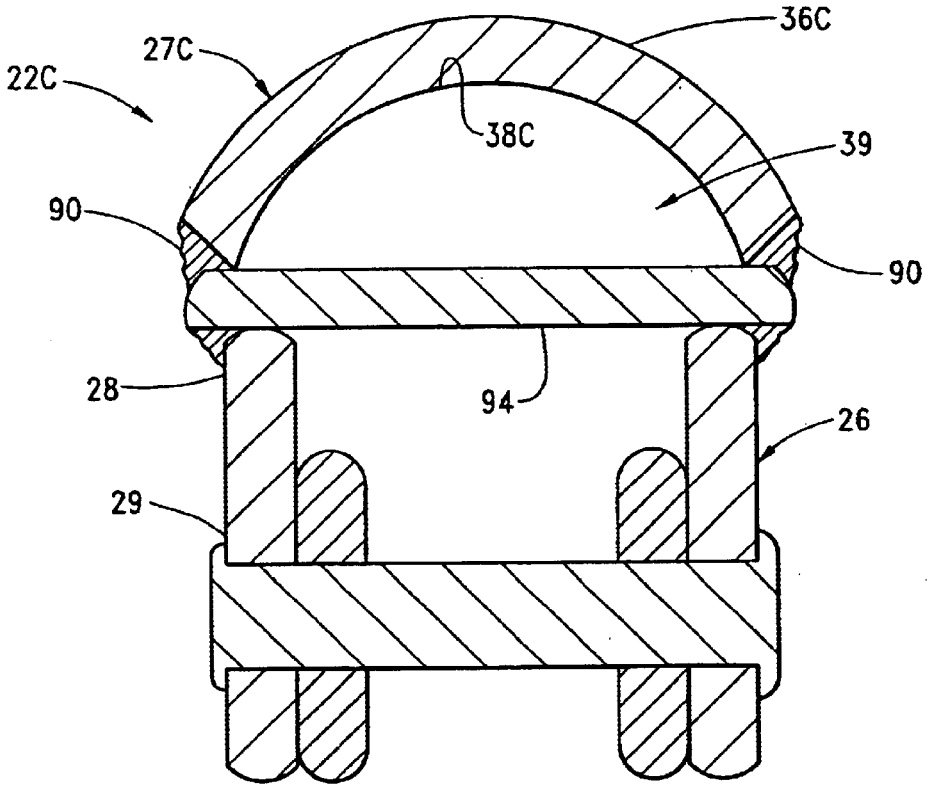
FIG. 9 is a cross sectional view similar to FIG. 6 illustrating another embodiment of the present invention wherein the arcuate member is supported by a riser member that, in turn, bridges the side plates.

FIG. 9 illustrates yet another preferred embodiment of the support member 27. In this embodiment, the cutter link 22C has a riser member 94 interposed between the side plates 26 and the support member 27C. The riser member 94 extends beyond the side plates 26 to provide a large diameter arcuate support surface 36C of the support member 27 for the attachment of cutting members 20. The arcuate support surface 36C of the support member 27, is attached to the riser member 94, such as by the weldments 90. It may also be noted that the riser member 94 can be attached in other conventional manners such as but not limited to threaded fasteners, adhesives, crimps, clamps and the like.

Figure 10:
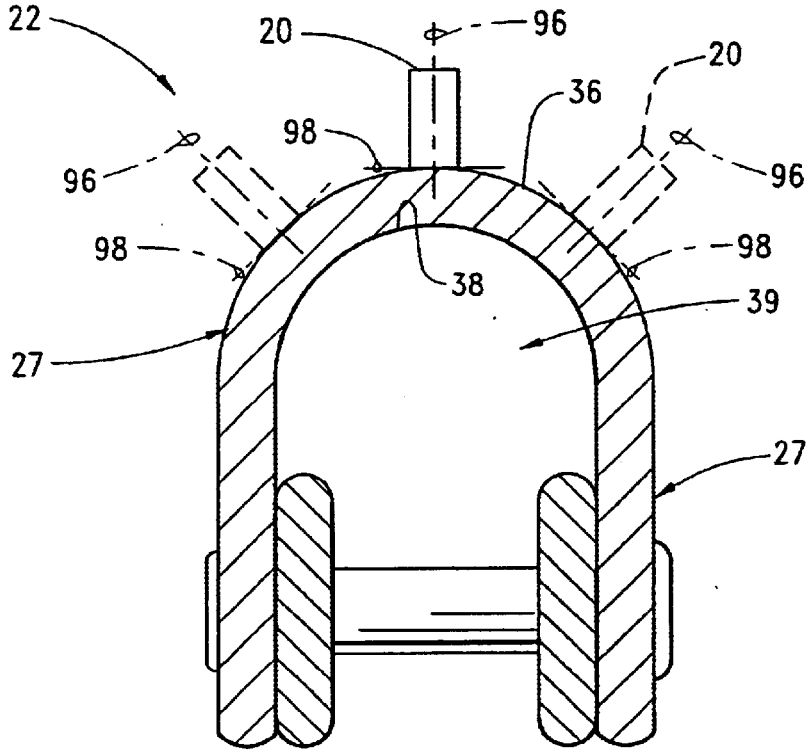
FIG. 10 is a diagrammatic end view of the cutting link illustrating the orthogonal relationship of the cutting member relative to the arcuate support surface regardless of the cutting tool position along the support member.

Turning now to FIG. 10, there is shown therein preferred positions of attaching a cutting member 20 to the arcuate support surface 36. For purposes of comparison, the cutting member 20 is shown in a top-center position in solid lines and in two alternative positions along the arcuate support surface 36 in broken lines. In each case, the longitudinal central axis of the cutting member 20 is denoted by reference numeral 96. Another reference line denoted by reference numeral 98 denotes the plane tangent to the arcuate support surface 36 and intersecting the longitudinal central axis 96. It will be noted, therefore, that the longitudinal central axis 96 is substantially orthogonal to the tangent plane 98 regardless of the desired position of the cutting member 20 upon the arcuate support surface 36.

Alternatively, the arcuate support surface 36 may support a plurality of cutting members 20 positioned on the arcuate support surface 36 in much the same manner as illustrated in FIG. 10. For example, in one preferred embodiment, the arcuate support surface 36 supports at least three cutting members 20. The plurality of cutting members 20 are disposed in a laterally offset relationship at substantially the same longitudinal position on the arcuate support surface 36. Additionally, the support member 27 and the cutting members 20 are adapted to permit substantially unrestricted selection of the lateral position of each cutting member on the arcuate support surface 36 of the support member. This is possible because the bottom ends 54 of each of the plurality of cutting members 20 are supported by the arcuate support surface 36 such that the bottom end of the cutting member is positioned orthogonally relative to the plane 98 that is tangent to the arcuate support surface 36 regardless of the position of the cutting member on the arcuate support surface 36.

The arcuate support surface 36 is preferably symmetrical about a longitudinal plane, and the position of each cutting member 20 on the support surface may be denoted by its polar angle relative to that plane. This polar angle is the included angle defined by the plane of symmetry, and the radius which joins the center of curvature of the arcuate support surface 36 to the point of attachment of the cutting member 20 on the arcuate support surface 36. A wide cutting swath may be produced by positioning cutting members 20 on opposite sides of the plane of symmetry at large polar angles, up to 90 degrees. A narrower cutting swath may be produced by selection of smaller polar angles for the opposed cutting members 20.

Thus, it may be noted that the cutting members 20 are moved farther from the top-center position in order to provide a wider cutting swath as compared with the cutting swath produced by cutting members that are closer to the top center position. Nevertheless, by maintaining the orthogonal supporting relationship, relatively less cutting member 20 mass is required to penetrate the subterranean matter as compared with cutting member mass required to penetrate subterranean matter with cutting members that do not maintain the orthogonal relationship. This enables the cutting chain 16 to dig with less resistive drag and therefore operate more efficiently.

In a preferred embodiment, in order to achieve maximum cutting efficiency, the plane 62 (FIG. 5) defined by body 50 and the cutting edge 58 of the cutting member 20 is uncanted relative to a direction of travel of the cutting chain. As a result, the planes 62 of the cutting members 20 on the support member 27 will be parallel to each other and parallel to the direction of travel of the cutting chain 16. Alternatively, there are situations in which the plane 62 defined by the body 50 and the cutting edge 58 of the cutting member 20 is desired to be canted. For example, to decrease excessive wear of the cutting member 20 and undermining the carbide of the cutting bit 56 canting is desired.

It may be noted that the orthogonal disposition of the cutting member 20 relative to the plane 98 tangent to the arcuate support surface 36 does not preclude canting the cutting members 20 if desired as discussed above. For the purpose of this discussion, "canting" means rotating the cutting member 20 about some point along the longitudinal central axis 96. That is, the plane 62 which contains the body 50 and the cutting edge 56 may be rotated and oriented to a desired angle relative to the direction of travel of the cutting chain 16 in order to produce a desired cutting width of the excavated trench 11.

Figure 11:
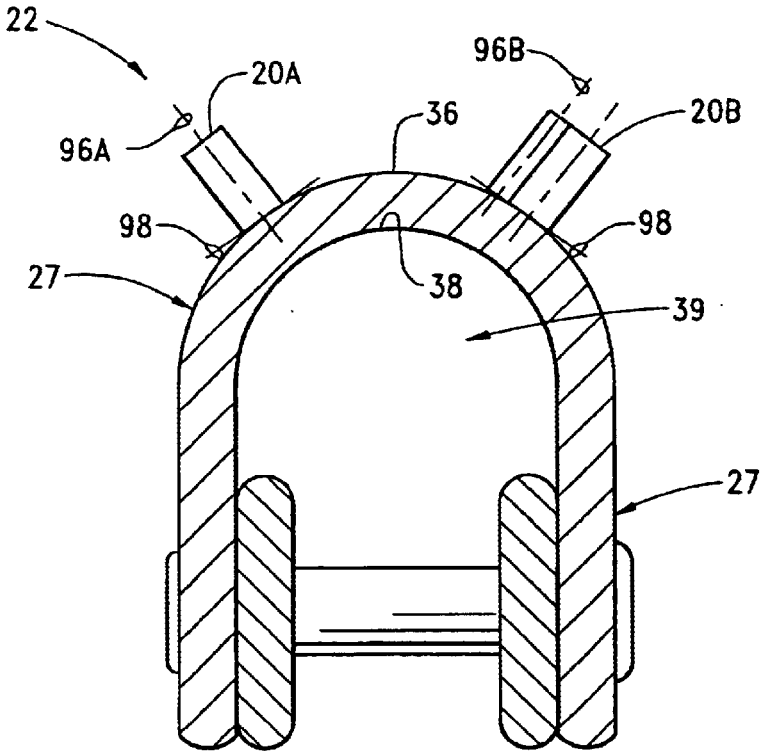
FIG. 11 is a diagrammatic end view similar to FIG. 10 illustrating the orthogonal relationship of the cutting member relative to the arcuate support surface regardless of the cutting member skew.
Figure 12:
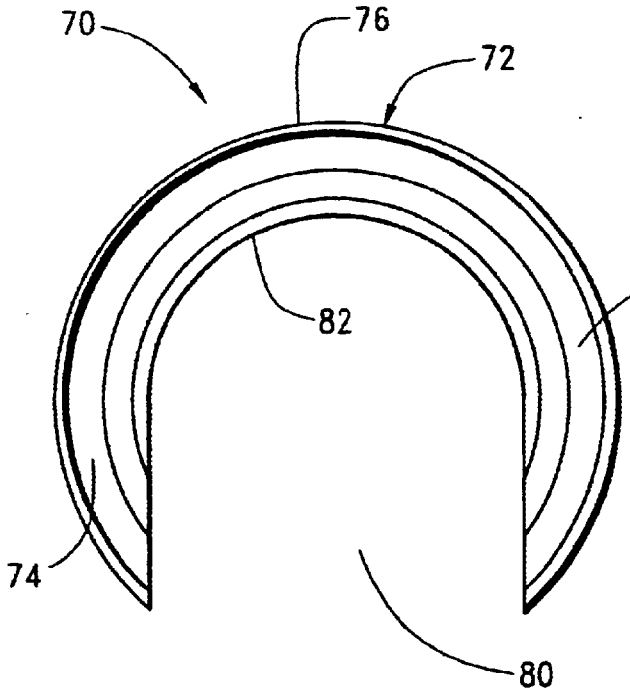
FIGS. 12–15 are illustrative views of a drag plate constructed in accordance with the present invention.
Figure 13:
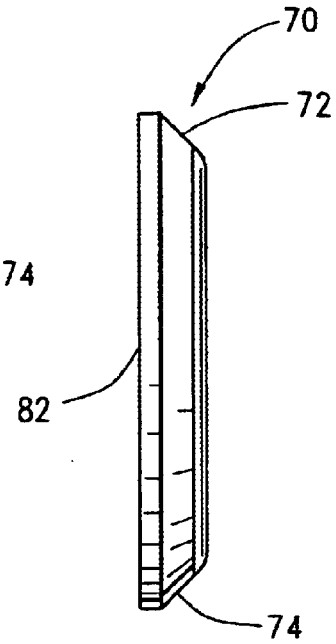
Figure 14:
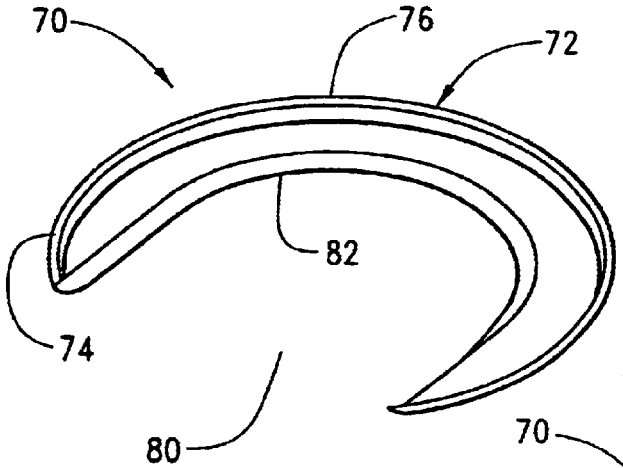
Figure 15:
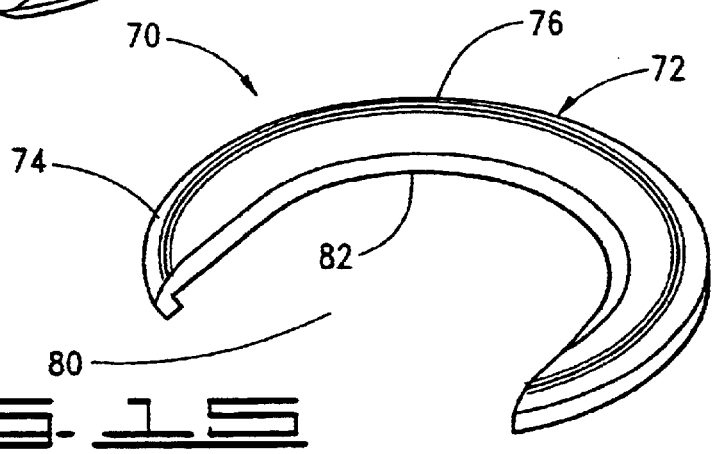
Figure 7:
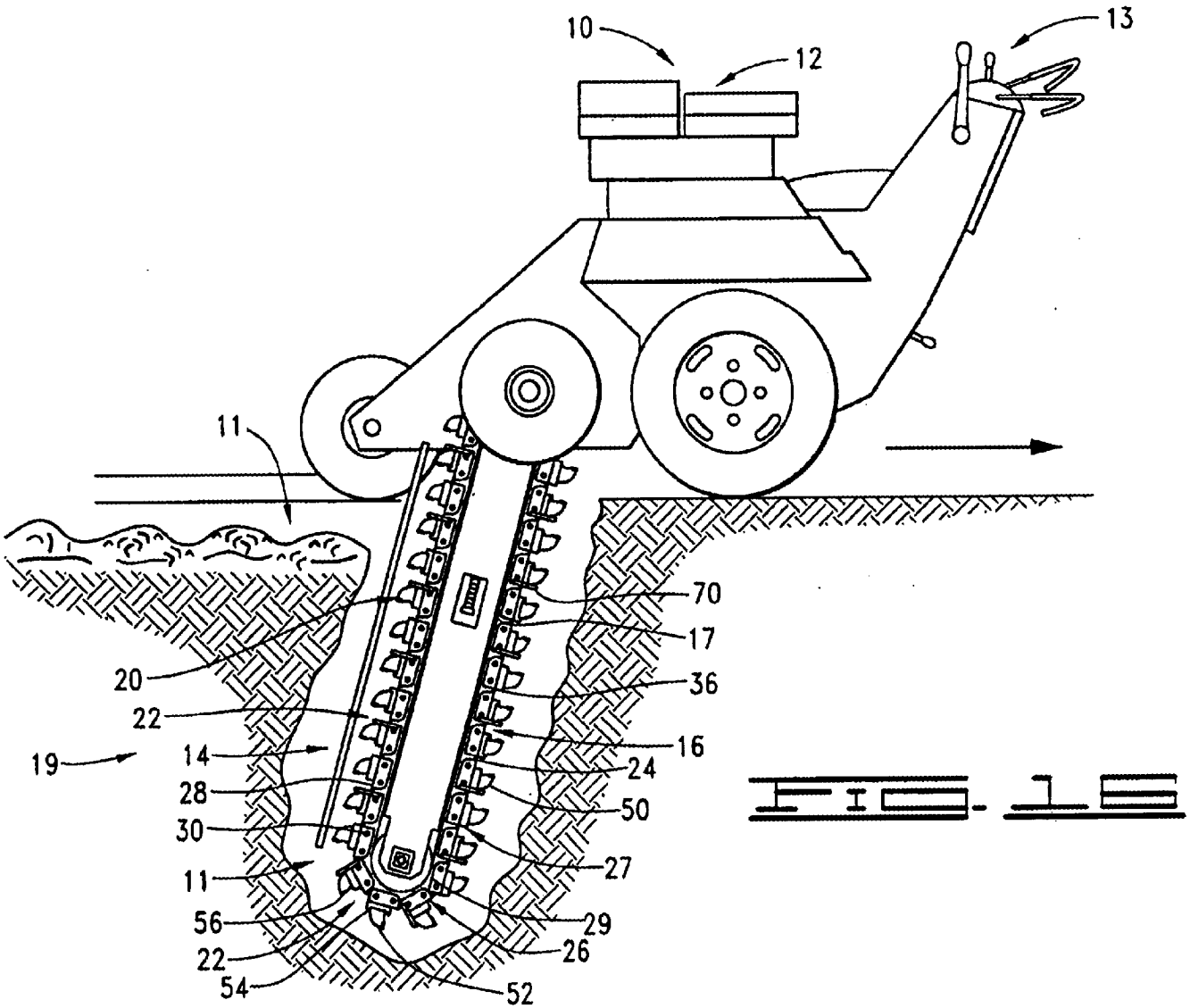

FIG. 11 illustrates two off-center-cutting members 20 of FIG. 10. Cutting member 20A is longitudinally aligned with the supporting arcuate member 27. That is, the longitudinal central axis 96A is substantially parallel with the cutter link 22 direction of travel. The other cutting member 20B is canted such that the longitudinal central axis 96B of the cutting member 20B (shown at both the leading and trailing ends of the cutting member 20B) is substantially nonparallel with the cutting link direction of travel. In both cases, the longitudinal central axis 96 of the cutting member 20 is substantially orthogonal to the plane 98 that is tangent to the arcuate support surface 36 at the point of attachment thereto.

In this manner, tilting of the cutting member 20 at an angle relative to the plane 98 that is tangent to the arcuate support surface 36 is not necessary to achieve the desired width of cutting action. For the purpose of this discussion, "tilting" means attachment of the cutting member 20 to the support member 27 at an angle that defeats the substantially orthogonal disposition of the cutting member relative to the plane that is tangent to the arcuate support surface 36 of the support member 27.

It may be noted that the arcuate shape of the cutting profile of cutting members 20 together with the arcuate upper edge 76 of the drag plate 70 assists in producing a characteristically rounded trench 11 bottom by scooping up the fractured and loosened materials out of the trench 11. This is particularly advantageous when round material is being placed in the trench 11, such as pipe or cable lines because the rounded bottom trench 11 tends to locate and support the pipe in the center of the trench during pipe make-up and trench back-fill operations.

A preferred additional feature of the support member 27 is its ability to dig a wide width trench 11 if desired by using the riser member 94 attached to the support member 27. That is, the riser member 94 provides a way of increasing the width of the trench 11 with the cutter link 22 arrangement of FIGS. 6–8 by increasing the length (or in other words, the effective height) of the cutting member 20. Additionally, the riser member 94 of FIG. 9 will effectively increase the trench 11 width capability for a given size cutting member 20 by positioning the cutting members 20 around a relatively larger diameter of the support member 27C than the support members of FIGS. 6–8.

Additionally, the arcuately shaped interior passage 39 of the support member 27 remains substantially unobstructed as it extends through the length of the cutting chain 16. Therefore, the interior passage provides relief for extrusion of the cut loose materials as the cutting chain engages its drive mechanism. As a result, the cutting members 20 are able to fracture the subterranean matter efficiently without obstruction from the cut loose materials. Further, it may be noted that the arcuate support surface 36 of the support member 27 permits the cutting members 20 to be supported with the plane 62 of the body 50 and the cutting edge 58 of the cutting member being uncanted relative to a direction of travel of the cutting chain 16 so that the cutting members are able to fracture the subterranean materials at maximum cutting efficiency. In this manner, when the plane 62 is parallel to the longitudinal axis 96 of the cutting chain 16, this presents the lowest possible cutting profile for the cutting chain.

It may be noted that the drag plate 70 serves to drag loose material out of the trench 11 so as to result in a substantially cleaner trench 11. That is, relatively more of the loosened subterranean matter is removed from the trench 11 by a cutting chain 16 that comprises the drag plates 70 than by a cutting chain that does not have drag plates.

Additionally, the side portions 74 of the drag plate 70 are extended down the side plates 26 to provide a shield for the trailing rivets 30 without having to cover the rivets. As a result, the rivets 30 can be easily accessed for removal and replacement in the event of excessive wear during operation. This is important because excessive drag wear of the heads of rivets 30 may result in premature failure of the cutting chain 16, and likely cause catastrophic failure. In the preferred embodiment, as the cutting action of the cutting chain 16 moves the cutter link 22 in a direction denoted 100 (FIG. 5), the drag plate 70 extends outwardly at the side portion 74 to protect the trailing rivet 30 substantially from any abrasive engagement with the sidewall of the trench 11. Thus, drag wear is borne by the drag plate 70, rather than by the rivets 30, thereby protecting the heads of the rivets 30 from excessive drag wear.

It is clear that the present invention is well adapted to attain the ends and advantages mentioned as well as those inherent therein. While a presently preferred embodiment of the invention has been described for purposes of the disclosure, it will be understood that numerous changes may be made in the construction, operation and arrangement of the various elements, steps and procedures without departing from the spirit and scope of the invention.

What is claimed is:

1. A cutting chain comprising a plurality of cutter links with a strap link joining adjacent cutter links forming an endless chain, wherein at least one cutter link comprises:

a pair of side plates;

a support member bridging the side plates, the support member having an arcuate support surface with a convex outer surface;

at least one cutting member attached onto the arcuate support surface of the support member; and a drag plate attached to the outer surface of the support member.

2. The cutting chain of claim 1 wherein the side plates are substantially parallel to each other.

3. The cutting chain of claim 1 comprising a plurality of cutting members, each cutting member having a bottom end and being supported by the support surface such that the bottom end of the cutting member is positioned orthogonally relative to a plane tangent to the support surface.

4. The cutting chain of claim 3 wherein each cutting member comprises a body having a cutting edge, the body and the cutting edge defining a plane that is uncanted relative to a direction of travel of the cutting chain.

5. The cutting chain of claim 3 wherein each cutting member comprises a body having a cutting edge, the body and the cutting edge defining a plane that is canted relative to a direction of travel of the cutting chain.

6. The cutting chain of claim 1 wherein the drag plate comprises: an arcuate portion; and a pair of side portions extending downwardly from the arcuate portion, with each side portion being attached to a corresponding side plate.

7. The cutting chain of claim 1 wherein the drag plate is attached orthogonally relative to the longitudinal axis of the support member.

8. The cutting chain of claim 1 wherein the drag plate is attached non-orthogonally relative to the longitudinal axis of the support member.

9. The cutting chain of claim 1 wherein the drag plate is characterized by a concave excavating surface.

10. The cutting chain of claim 1 wherein the support member is characterized by an interior passage that extends substantially parallel to the direction of travel of the cutting chain.

11. A cutter link for a cutting chain comprising:

a pair of side plates;

an arcuate support member bridging the side plates, the arcuate support member having a convex outer surface;

at least one cutting member attached onto the support member; and a drag plate attached to the outer surface of the support member.

12. The cutter link of claim 11 wherein the cutter link further comprises a riser member interposed between the side plates and the support member.

13. The cutter link of claim 11 wherein the side plates are substantially parallel to each other.

14. The cutter link of claim 11 comprising a plurality of cutting members, each cutting member having a bottom end and being supported by the support surface such that the bottom end of the cutting member is positioned orthogonally relative to a plane tangent to the support surface.

15. The cutter link of claim 14 wherein each of the plurality of cutting members comprise a body having a cutting edge, the body and the cutting edge defining a plane that is uncanted relative to a direction of travel of the cutting chain.

16. The cutter link of claim 14 wherein each of the plurality of cutting members comprise a body having a cutting edge, the body and the cutting edge defining a plane that is canted relative to a direction of travel of the cutting chain.

17. The cutter link of claim 11 wherein the drag plate further comprises: an arcuate portion; and a pair of side portions extending downwardly from the arcuate portion, with each side portion being attached to a corresponding side plate.

18. The cutter link of claim 11 wherein the drag plate is attached orthogonally relative to the longitudinal axis of the support member.

19. The cutter link of claim 11 wherein the drag plate is attached non-orthogonally relative to the longitudinal axis of the support member.

20. The cutter link of claim 11 wherein the drag plate is characterized by a concave excavating surface.

21. The cutter link of claim 11 wherein the support member is characterized by an interior passage that extends substantially parallel to the direction of travel of the cutting chain.

22. A cutting chain comprising a plurality of cutter links forming an endless chain, wherein at least one cutter link comprises:

a support member comprising:

a pair of spaced planar side sections;

a bridge section interposed between the side sections, the bridge section comprising an arcuate support surface formed in a medial portion thereof, the support surface having a convex outer surface;

a drag plate attached to the outer surface of the bridge section; and a plurality of cutting members supported by the support surface.

23. The cutting chain of claim 22 wherein the support member of the cutter link is characterized by an arcuate interior passage that extends substantially parallel to the direction of travel of the cutting chain.

24. The cutting chain of claim 22 wherein the drag plate comprises an upper portion having an arcuate upper edge and downwardly extending side portions, each side portion being attached to a corresponding lower portion of each side plate.

25. The cutting chain of claim 22 wherein the plurality of cutting members comprise a body having a cutting edge, the body and the cutting edge defining a plane that is uncanted relative to a direction of travel of the cutting chain.

26. The cutting chain of claim 22 wherein the plurality of cutting members comprise a body having a cutting edge, the body and the cutting edge defining a plane that is canted relative to a direction of travel of the cutting chain.

27. A cutter link for a cutting chain comprising:

a support member having an arcuate support surface with a convex outer surface;

a drag plate attached to the outer surface of the support member; and a plurality of cutting members disposed in laterally offset relationship at substantially the same longitudinal position on the arcuate support surface;

wherein the support member and the cutting members are adapted to permit substantially unrestricted selection of the lateral position of each cutting member on the arcuate support surface of the support member.

28. The cutter link of claim 27 wherein the drag plate comprises an upper portion having an arcuate upper edge and downwardly extending side portions, each side portion being attached to a corresponding lower portion of each side plate.

29. The cutter link of claim 27 wherein each of the plurality of cutting members comprise a body having a cutting edge, the body and the cutting edge defining a plane that is uncanted relative to a direction of travel of the cutting chain.

30. The cutter link of claim 27 wherein each of the plurality of cutting members comprise a body having a cutting edge, the body and the cutting edge defining a plane that is canted relative to a direction of travel of the cutting chain.

31. The cutter link of claim 27 wherein the support member of the cutter link is characterized by an arcuate interior passage that extends substantially parallel to the direction of travel of the cutting chain.

32. A cutting chain comprising a plurality of cutter links with a strap link joining adjacent cutter links forming an endless chain, wherein at least one cutter link comprises:

a pair of side plates;

a support member bridging the side plates, the support member having an arcuate support surface with a convex outer surface; and wherein the support member is characterized by an unobstructed arcuate interior passage that extends substantially parallel to the direction of travel of the cutting chain; and a drag plate attached to the outer surface of the support member.

33. The cutting chain of claim 32 wherein the side plates are substantially parallel to each other.

34. The cutting chain of claim 32 wherein the drag plate comprises an arcuate portion.

35. The cutting chain of claim 34 wherein the drag plate further comprises a pair of side portions extending downwardly from the arcuate portion, with each side portion being attached to a corresponding side plate.

36. The cutting chain of claim 32 wherein the drag plate is attached orthogonally relative to the longitudinal axis of the support member.

37. The cutting chain of claim 32 wherein the drag plate is attached non-orthogonally relative to the longitudinal axis of the support member.

38. The cutting chain of claim 32 wherein the drag plate is characterized by a concave excavating surface.

39. A cutting chain comprising a plurality of cutter links interconnected by strap links to form an endless chain, wherein at least one cutter link comprises:

a pair of side plates;

a support member bridging the side plates, the support member having a convex outer surface;

a drag plate supported on the outer surface of the support member; and a pair of fastening members disposed adjacent the drag plate and adapted to connect each side plate to a strap link wherein the drag plate is characterized having depending side portions which shield the fastening members.

40. The cutting chain of claim 39 wherein the support member comprises an arcuate support surface.

41. The cutting chain of claim 40 further comprising at least one cutting member attached onto the arcuate support surface of the support member.

42. The cutting chain of claim 41 wherein the cutting member comprises a body having a cutting edge, the body and the cutting edge defining a plane that is canted relative to a direction of travel by the cutting chain.

43. The cutting chain of claim 41 wherein the cutting member comprises a body having a cutting edge, the body and the cutting edge defining a plane that is uncanted relative to a direction of travel of the cutting chain.

44. The cutting chain of claim 41 wherein the cutting member comprises a body having a cutting edge, the body and the cutting edge defining a plane that is canted relative to a direction of travel of the cutting chain.

* * * * *